US005797420A

United States Patent [19]

Nowicki et al.

[11] Patent Number: 5,797,420

[45] Date of Patent: *Aug. 25, 1998

[54] PROPORTIONER

[75] Inventors: Michael L. Nowicki, House Springs; Paul E. Naslund, St. Louis, both of Mo.

[73] Assignee: Dema Engineering Co., St. Louis, Mo.

[ * ] Notice: The term of this patent shall not extend beyond the expiration date of Pat. No. 5,518,020.

[21] Appl. No.: 650,755

[22] Filed: May 20, 1996

Related U.S. Application Data

[63] Continuation of Ser. No. 259,631, Jun. 14, 1994, Pat. No. 5,518,020.

[51] Int. Cl.[6] ..... E03C 1/10

[52] U.S. Cl. ..... 137/216; 137/888

[58] Field of Search ..... 137/216, 888, 137/893, 896

[56] References Cited

U.S. PATENT DOCUMENTS

| | | | |
|---|---|---|---|
| 2,631,448 | 3/1953 | Garman | 137/216 X |
| 3,166,086 | 1/1965 | Holmes | 137/217 |
| 4,697,610 | 10/1987 | Bricker et al. | 137/216 X |
| 5,159,958 | 11/1992 | Sand | 137/888 |
| 5,253,677 | 10/1993 | Sand | 137/888 |
| 5,518,020 | 5/1996 | Nowicki et al. | 137/216 |

*Primary Examiner*—Gerald A. Michalsky
*Attorney, Agent, or Firm*—Cohn, Powell & Hind

[57] ABSTRACT

This proportioner (10) is used in conjunction with a water supply connector (12) to provide a fluid mixing device for water and liquid detergent. The proportioner (10) includes a valve body (20) providing an inlet nozzle (14) and an air gap chamber (15) and an outlet (18) housing a venturi system (16). The venturi system (16) includes a venturi nozzle (40) aligned with the inlet nozzle (14) and having deflecting flats (42), a venturi tube (46) and a venturi throat (52) communicating with a detergent induction fitting (50).

9 Claims, 1 Drawing Sheet

PROPORTIONER

This is a continuation of application Ser. No. 08/259,631 filed on Jun. 14, 1994, now U.S. Pat. No. 5,518,020.

BACKGROUND OF THE INVENTION

This invention relates generally to fluid mixing devices and in particular to a proportioning device that mixes liquid detergent with a stream of water.

Fluid mixing devices for mixing a liquid detergent with a stream of water issuing from a water supply are well known and have been used for many years, particularly in conjunction with washing articles such as dishes in restaurants.

Such prior art devices typically make use of the venturi principle for inducing the liquid detergent into the water stream and two features are particularly desirable. One feature is the desirability of avoiding the problem of vacuum effect which can cause the backflow of the detergent/water mix upstream into the water supply. This is counteracted by providing an anti-syphoning air gap between the inlet nozzle and the venturi nozzle and using a special venturi nozzle design. An example of this type of device is shown in U.S. Pat. No. 3,166,086 owned by the assignee of the present invention. This arrangement functions effectively but may result in the discharge and overspill of the detergent/water mix through the air gap between the venturi nozzle and the inlet nozzle.

The other feature is the desireability of avoiding this overspill problem. U.S. Pat. No. 5,253,677 and U.S. Pat. No. 5,159,958 disclose approaches to the solution of the second problem by providing a splash plate upstream of the venturi nozzle, such as shown in both patents, and also the provision of barriers adjacent to the windows which provide the air gap. This solution requires additional parts which results in added complexity of manufacture of molded parts and the resulting expense.

The present proportioner solves these and other problems in a manner not disclosed in the known prior art.

SUMMARY OF THE INVENTION

This proportioner for mixing liquid detergent into a water stream avoid the problem of backflow of contaminating liquid detergent into the water supply, yet substantially precludes the escape of the liquid leakage through the air gap.

This liquid proportioner comprises a valve body including an inlet, an outlet and an air gap chamber disposed between said inlet and said outlet, said air gap chamber including side opening means communicating with atmosphere; partition means disposed in said air inlet and including an inlet nozzle; and venturi means disposed in said outlet and at least partially spaced from said body to define outer passage means, said venturi means including a venturi nozzle, a venturi tube and an intermediate venturi throat, said venturi nozzle being axially aligned with said inlet nozzle and including a divergently tapered outer surface and an inner surface.

It is an aspect of this invention to provide that said divergently tapered outer surface of said venturi nozzle includes a plurality of flats and another aspect to provide that said flats are at least three in number.

It is another aspect of this invention to provide that said divergently tapered flats are inclined at about 10°–14° to the axis of alignment.

It is yet another aspect of this invention to provide that said inner surface of said venturi nozzle is convergently tapered.

It is still another aspect of this invention to provide that said inner surface taper is about 8° to the axis of alignment.

It is an aspect of this invention to provide that said inlet nozzle includes a convergently arcuate entrance portion and another aspect to provide that said inlet nozzle includes a straight exit portion.

It is an aspect of this invention to provide that a disc is transversely disposed within said body intermediate said inlet nozzle means and said venturi means, said disc having an opening sufficiently large to allow substantially unimpeded flow of liquid from said inlet nozzle to said venturi nozzle yet small enough so that said disc acts as a deflector to substantially preclude reverse flow from said venturi nozzle escaping from said side opening means.

It is another aspect of this invention to provide that said disc opening has a minimum dimension of between 30%–50% greater than the minimum diameter of the inlet nozzle.

It is a aspect of this invention to provide a proportioner which utilizes a simple and inexpensive arrangement of parts which is very efficient for its intended purpose.

DESCRIPTION OF THE PREFERRED EMBODIMENT

Figure 1:
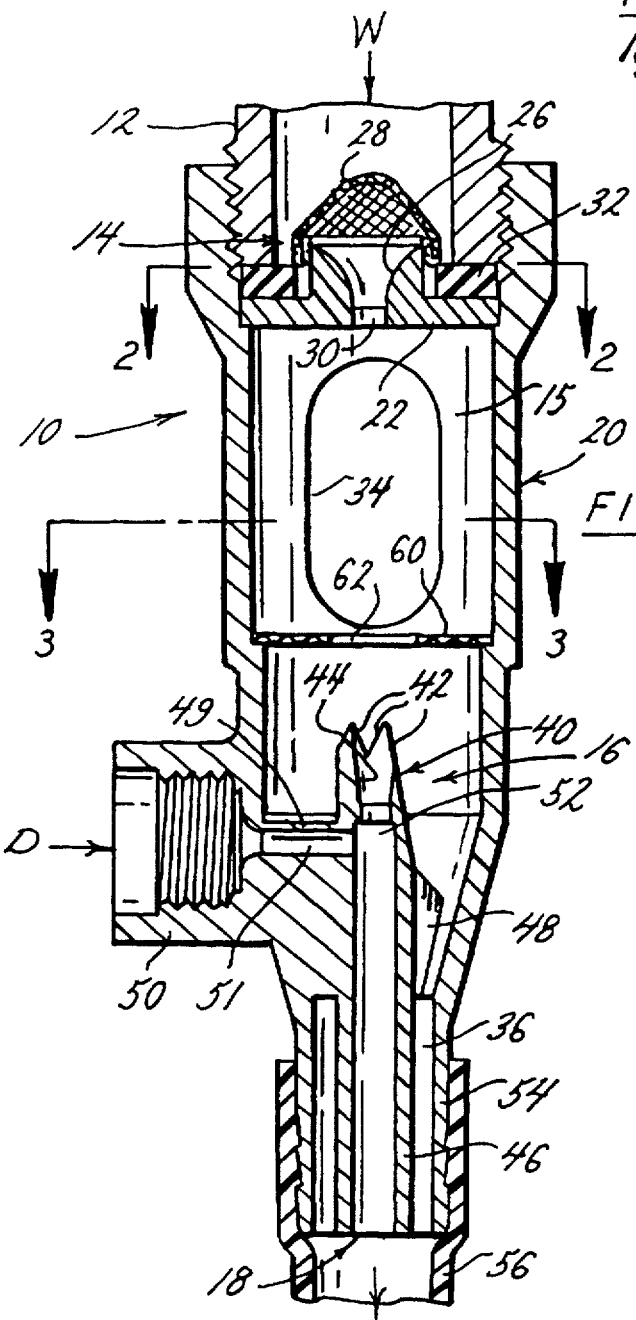
FIG. 1 is a longitudinal sectional view through the proportioner.
Figure 2:
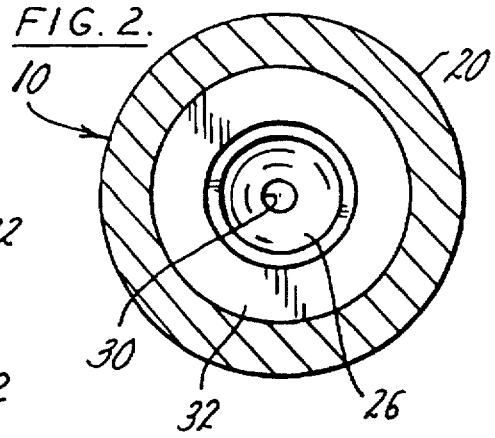
FIG. 2 is a cross-sectional view taken on line 2—2 of FIG. 1.
Figure 3:
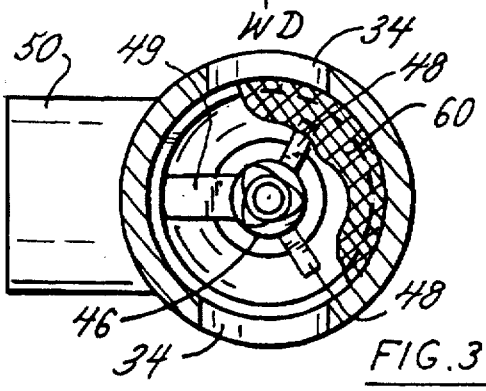
FIG. 3 is a cross-sectional view taken on line 3—3 of FIG. 1.
Figure 4:
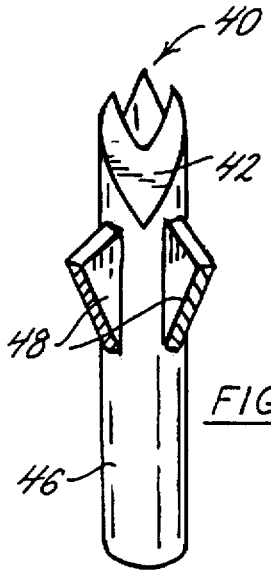
FIG. 4 is a perspective view of the venturi system.

Referring now by reference numerals to the drawing and first to FIG. 1 it will be understood that the proportioner 10 is threadedly attached at its upper end to a water supply connection 12. The proportioner 10 includes an inlet nozzle 14 receiving a water supply W from the connection 12, a venturi system 16 for inducing a liquid detergent from a detergent supply D into the water stream so that mixed liquid WD is delivered to the outlet 18.

More particularly, the proportioner 10 includes generally cylindrical body 20 recessed at the upper end to receive the nozzle 14. The nozzle 14 includes a partition 22 formed into an orifice having an arcuate entrance portion 26 receiving water from the connection 12 and a straight exit portion 30 directing the water downstream in a substantially straight axial path. A washer seal 32, which includes a dome-shaped strainer 28, is provided between the partition 22 and the connection 12.

The body 20 includes opposed oblong-shaped window slots 34 disposed between the venturi system 16 and the inlet nozzle 14 which are preferably about one inch long to meet code requirements and are disposed above said venturi system 16. The intermediate portion of the body 20, substantially between the inlet nozzle 14 and the venturi system 16, provides an air gap chamber 15 and, below the venturi system upper end, the body converges to provide an outer passage 36 forming part of the outlet 18.

The upper portion of the venturi system 16 includes an upper venturi nozzle 40 having an outer surface and an inner surface. The outer surface is formed by a plurality of tapered flats 42, three in number in the preferred embodiment, with the taper diverging in a downstream direction at an angle B which may be about 10°–14° depending on the flow requirements. The inner surface is formed from a conical surface 44, with the taper converging in a downstream direction at an included angle A of about 8°. In the embodiment shown, the venturi system 16 is molded into the body 20. The lower portion of the venturi system includes an elongated tube 46 having an inside diameter greater than the minimum diameter of the venturi nozzle 44, which is held in place within the lower body passage by a pair of fins 48 and a fin 49 to define the outer passage 36. The intermediate portion of the venturi system communicates with an induction fitting 50 which, in the embodiment shown, is molded into the body 20 and is internally threadedly for a detergent connection (not shown). The fitting 50 is connected to the venturi throat 52 by a passage 51, which passes through the rib 49 and serves to inject liquid detergent into the venturi throat 52 below the venturi nozzle. The body 20 is reduced in diameter at the lower, outlet end to form a spout 54 to receive a hose 56.

Figure 5:
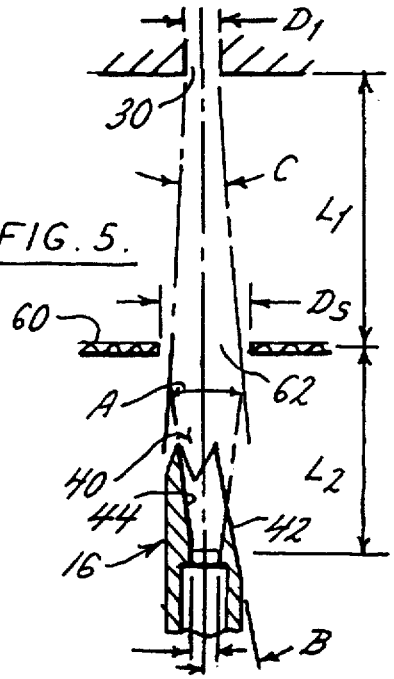
FIG. 5 is a schematic showing the water path between the inlet nozzle and the venturi nozzle.

A deflector disc 60 may be provided which, in the preferred embodiment is an 80 mesh stainless steel plain weave screen formed from 0.006 inch diameter wire. The screen disc 60 includes a central opening 62 having a minimum dimension Ds which is large enough to allow unimpeded flow of liquid from the inlet nozzle 14 to the venturi nozzle 40 without directing flow into said nozzle. As shown in FIG. 5 reverse flow due to upward splash from the venturi nozzle is met by the downward flow from the inlet nozzle at a point below the screen disc 60, i.e., less than $L_2$, and cooperates with the disc to divert flow into the outer passage 36. In the preferred embodiment a dimension Ds of about 30%–50% greater than the minimum diameter of the inlet nozzle has been found satisfactory. This arrangement provides a clear passage through the screen disc opening 62 for direct flow from the inlet nozzle, and avoids reverse flow from the venturi nozzle from escaping through the window openings. Stated mathematically, with reference to FIG. 5:

Ds is greater than $D_1+2L_1 \tan C/2$

Where $D_1$ is the minimum diameter of the inlet nozzle $D_2$ is the minimum diameter of the venturi nozzle and is less than $D_1$ $L_1$ is the distance from the inlet nozzle to the screen $L_2$ is the distance from the start of the venturi conical surface to the screen c is the included angle of inclination of the flow stream Ds is the minimum screen opening dimension It is thought that the structural features and functional advantages of the proportioner have become fully apparent from the foregoing description of parts. However, for completeness of disclosure the operation of the device will be briefly described.

The proportioner 10 is attached to the water supply connection 12 and receives water at the inlet end which is directed through the strainer 28 and the arcuately formed entrance of the inlet nozzle 14, to issue from the exit in a substantially axial stream. The stream of water passes through the air gap chamber 15 so that the inner portion of the stream is received by the venturi nozzle 44 and while the outer portion of the stream is deflected into the outer passage 36 by the configuration of the flats 42 as shown schematically in FIG. 5. The inner portion of the stream passes through the venturi system 16 and provides the necessary suction at the venturi throat 52 to induce liquid detergent into the water stream. The air gap provided by the windowed air gap chamber 15 provides an anti-siphoning function due to the separation of the inlet nozzle from the upper portion of the venturi nozzle 40 to prevent upstream backflow into the main water stream. In addition, the configuration of the venturi nozzle provides an anti-back splash function which essentially precludes the exit of mixed liquid through the windows and, in general, obviates the need for a backsplash disc or a window barrier to minimize leakage through the air gap chamber windows. This leakage prevention is assisted by the outer faceted surface of the venturi nozzle which, in effect, creates an outer water "shield". This "shield" substantially prevents upward movement of liquid resulting from downwardly diverging configuration of the venturi nozzle inner surface which is necessary to provide the required venturi effect to induce detergent into the water stream.

Though not always necessary, it may be advantageous as an additional precaution against leakage, in some instances, to provide a backsplash screen disc 60. This disc includes an opening large enough to receive the water stream from the inlet nozzle 14, but small enough so that the disc intercepts reverse flow.

Although the proportioner has been described by making detailed reference to a preferred embodiment, the details of description are not to be understood as restrictive numerous variants being possible within the scope of the claims hereunto appended.

We claim as our invention:

1. A liquid proportioner comprising:

(a) a valve body including an inlet, an outlet and an air gap chamber disposed between said inlet and said outlet, said air gap chamber including a sidewall having opposed generally vertical substantially unobstructed and axially aligned window slots communicating with atmosphere, providing a substantially clear uninterrupted transverse passage through the proportioner and providing effective antisyphoning;

(b) partition means disposed in said inlet and including an inlet nozzle;

(c) venturi means disposed in said outlet and at least partially spaced from said body to define outer passage means, said venturi means including a venturi nozzle, a venturi tube and an intermediate venturi throat, said venturi nozzle being axially aligned with said inlet nozzle and including a divergently tapered outer surface which tapers toward a point in the direction of said inlet nozzle and an inner surface; and (d) said divergently tapered outer surface facilitating smooth liquid flow and inhibiting reverse flow to substantially preclude the exit of liquid through the window slots.

2. A proportioner as defined in claim 1, in which:

(e) said divergently tapered outer surface of said venturi nozzle includes a plurality of flats at least three in number spaced from said sidewall.

3. A proportioner as defined in claim 2, in which:

(f) said divergently tapered outer surface of said venturi nozzle includes only three flats.

4. A proportioner as defined in claim 1, in which:

(e) said divergently tapered outer surface of said venturi nozzle includes a plurality of flats inclined at about at least 10° to the axis of alignment to direct part of the liquid flow into said outer passage means.

5. A proportioner as defined in claim 1, in which:

(e) a disc having an axially aligned oversize opening is transversely disposed within said body intermediate said inlet nozzle means and said venturi means, said disc oversize opening being sufficiently large to allow substantially unimpeded flow of liquid from said inlet nozzle to said venturi nozzle yet small enough so that said disc area surrounding said oversize opening acts as a deflector to assist in substantially precluding reverse flow from said venturi nozzle exiting through said window slots.

6. A proportioner as defined in claim 5, in which:

(f) said disc oversize axially aligned opening has a minimum dimension of about at least 30% greater than the minimum diameter of the inlet nozzle.

7. A liquid proportioner as defined in claim 1, in which:

(e) an open mesh screen is transversely disposed within said body intermediate said inlet nozzle means and said venturi means, said screen having an axially aligned oversize opening sufficiently large to allow substantially unimpeded flow of liquid from said inlet nozzle to said venturi nozzle yet small enough so that said screen area surrounding said oversize opening acts as a deflector to assist in substantially precluding reverse flow from said venturi nozzle exiting through said unobstructed window slots.

8. A liquid proportioner comprising:

(a) a valve body including an inlet, an outlet and an air gap chamber disposed between said inlet and said outlet, said air gap chamber including side opening means communicating with atmosphere;

(b) partition means disposed in said inlet and including an inlet nozzle; and (c) venturi means disposed in said outlet and at least partially spaced from said body to define outer passage means, said venturi means including a venturi nozzle, a venturi tube and an intermediate venturi throat, said venturi nozzle being axially aligned with said inlet nozzle and including an outer surface which tapers toward a point in the direction of said inlet nozzle.

9. A liquid proportioner as defined in claim 8, in which:

(d) the side opening means includes opposed, generally axially aligned window slots providing a clear uninterrupted transverse passage through the proportioner.

* * * * *